United States Patent [19]

Mitch

[11] 4,091,638

[45] May 30, 1978

[54] COOLING SYSTEM FOR HERMETIC COMPRESSOR

[75] Inventor: George Charles Mitch, York, Pa.

[73] Assignee: Borg-Warner Corporation, Chicago, Ill.

[21] Appl. No.: 750,082

[22] Filed: Dec. 13, 1976

[51] Int. Cl.[2] ..... F25B 43/02; F04B 17/00; F04B 35/00; F01C 21/04

[52] U.S. Cl. ..... 62/470; 417/902; 418/100

[58] Field of Search ..... 62/469, 470, 471, 468; 184/6.16, 6.18; 417/372, 902; 418/100; 210/168

[56] References Cited

U.S. PATENT DOCUMENTS

| | | | |
|---|---|---|---|
| 1,566,919 | 12/1925 | Parkyn | 62/470 |
| 1,878,403 | 9/1932 | Kagi | 62/470 |
| 2,787,136 | 4/1957 | Wurtz | 417/902 |
| 3,408,826 | 11/1968 | Soumerai et al. | 62/470 |
| 3,408,827 | 11/1968 | Soumerai et al. | 62/196 |
| 3,408,828 | 11/1968 | Soumerai et al. | 62/470 |
| 3,833,318 | 9/1974 | Nakayama et al. | 418/100 |

*Primary Examiner*—Lloyd L. King
*Attorney, Agent, or Firm*—Thomas B. Hunter

[57] ABSTRACT

A hermetic rotary refrigerant compressor is provided with means for handling the oil and refrigerant vapor mixture to provide sufficient cooling of the motor without external precoolers and related conduits and apparatus. In a preferred embodiment, the oil is collected and caused to flow along a portion of the internal surface of the hermetic shell in such a way that the shell itself functions as a heat exchanger. The heat is transferred through the shell to the cooler ambient air in contact with the external surface thereof.

5 Claims, 5 Drawing Figures

COOLING SYSTEM FOR HERMETIC COMPRESSOR

BACKGROUND OF THE INVENTION

1. Field of the Invention

Hermetic refrigerant compressors provided with means for cooling the lubricant to maintain high efficiency and long operating life for the compressor drive motor.

2. Description of the Prior Art

U.S. Pat. No. 2,854,594 discloses a motor containing an enclosed lubricating system wherein the temperature of the lubricant is reduced through heat exchange with the motor casing, the latter including cooling fins or ribs. The disclosure in this patent fails to suggest this feature in combination with a refrigerant compressor nor the specific means for handling a refrigerant and lubricant mixture.

U.S. Pat. No. 3,408,827 is directed to a screw compressor in which a mixture of refrigerant and oil is directed on the motor for cooling purposes. Centrifugal action imparted by the motor on the mixture is operable to separate a substantial portion of the oil which is directed to an oil sump or cooler. This patent fails to disclose the concept of using a portion of the casing wall for heat exchange and requires a separate oil cooler which the present invention seeks to avoid.

U.S. Pat. No. 3,663,127 discloses a hermetic compressor and cooling system for the motor therein. The lubricating oil is directed against the motor windings by means of an oil pump disposed in the lower portion of the compressor shell. The oil then flows downwardly along the inside surface of the casing walls in returning to the sump. Any lubricant coming into contact with the walls is on a somewhat random basis in that there are no means provided for specifically directing the refrigerant-lubricating oil mixture to this area.

U.S. Pat. No. 3,833,318 describes a rotary compressor in which the incoming oil is subjected to an abrupt change in direction to aid in separating the oil from the refrigerant. While some oil will inherently flow against the inside walls of the casing, there is no suggestion that this is effective in any way to cool the same.

U.S. Pat. No. 2,979,917 provides a cooling system for a hermetic compressor which includes a de-superheating coil. Discharge gas is caused to flow through the coil and into the chamber in which the drive motor is located. This, of course, necessitates a separate coil which is avoided by the present invention.

U.S. Pat. No. 3,727,420 also provides a de-superheating coil and is similar in many respects to the aforementioned U.S. Pat. No. 2,979,917.

U.S. Pat. No. 2,492,611 shows a hermetic compressor in which an oil cooling system is provided with a line conducting oil collected in a sump to the upper portion of the shell. The oil is sprayed against the upper surface of the shell and flows down along the inside wall where it is cooled by contact therewith.

U.S. Pat. No. 3,922,114 is directed to a screw compressor which uses discharge gas and entrained oil to cool the motor. The mixture of gas and oil is directed against the walls of the shell to induce separation.

SUMMARY OF THE INVENTION

This invention relates to hermatic compressors provided with means for separating and cooling the refrigerant-lubricating oil mixture. In a preferred embodiment, the cooling is accomplished by directing the oil and refrigerant vapor mixture from the compressor chamber against a porous ring to effect substantial separation of oil from the mixture and then direct the oil so separated by gravity downwardly along the inner wall of the casing enclosure, i.e. the external shell, toward the oil sump at the bottom of the enclosure. After such separation from the mixture, the oil is cooled through heat exchange with the casing wall. Since the compressor shell is relatively thin and made of heat conducting material, the ambient air circulating on the outside of the compressor can cool the oil to a satisfactory temperature level. Fins or other heat exchange augmentation devices may be used to increase the rate of heat transfer. The cooler oil then mixes with the reservoir of oil in the sump, and this mixture is then directed against the motor windings, the rotor etc. to effect satisfactory cooling of the motor.

Separation of the oil from the mixture is enhanced by centrifugal force and suitable flow guide means may be used to direct the oil onto the shell wall, rather than to rely solely on gravity and free fall. This will insure that the oil wets the shell wall and spreads to form a thin film on the interior wall of the shell for better heat exchange.

DESCRIPTION OF THE PREFERRED EMBODIMENT

As indicated in the preliminary remarks, it is a primary objective of this invention to provide improved means to limit the operating temperatures of the electric motor and the lubricant in the sump of a hermetic refrigerant compressor. This is accomplished by first separating the oil from the refrigerant vapor and oil mixture discharged from the compression chamber and then directing this oil to flow along the inner wall of the compressor shell to the sump, said oil being cooled in the process by rejecting heat through the shell wall to the ambient air. This cooled oil is then utilized to remove the heat from the electric motor, bearings, and other moving parts within the compressor shell.

Figure 1:
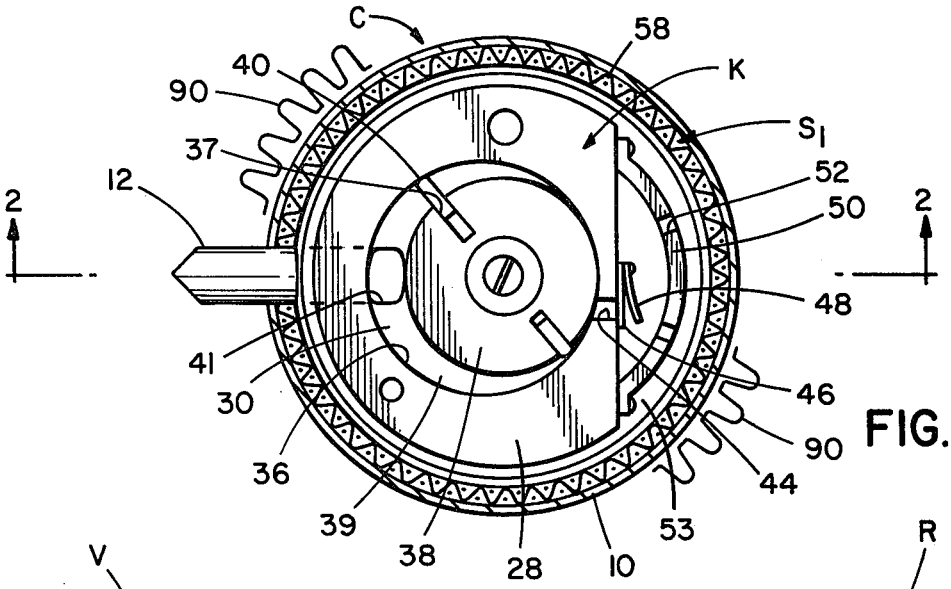
FIG. 1 is a top plan view, with the top section of the shell removed and certain portions broken away, of a hermetic compressor constructed in accordance with the principles of the present invention.
Figure 2:
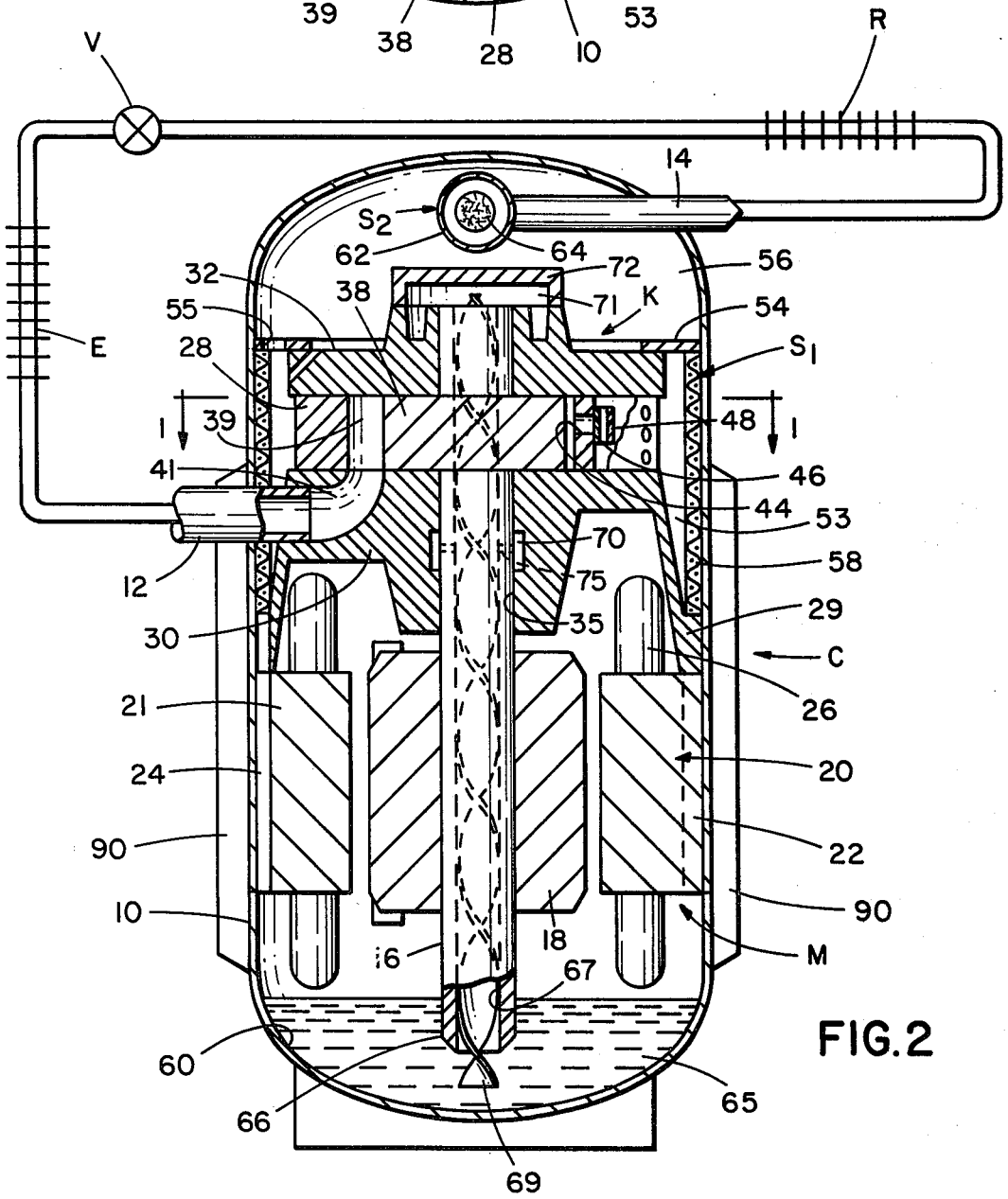
FIG. 2 is a cross section view taken along the plane of line 2—2 of FIG. 1.

Referring now to FIGS. 1 and 2 there is shown a compressor C in combination with a vapor compression cycle refrigeration system including a condenser R, an expansion device V, and an evaporator E all connected in closed circuit, series flow relation.

The compressor C, which is the subject of this invention, is of the rotary hermetic type in which the electric motor M and the vapor compressing unit K are all enclosed within a hermetically sealed shell 10 through which the suction line 12 and the discharge gas line 14 extend. One of the objects of this invention is to avoid the need for external heat exchangers and other such means for redirecting the refrigerant vapor and lubricating oil mixture. The only external refrigerant connections required on the compressor are the suction and discharge lines.

The compressor is arranged such that motor M is oriented with the driven shaft 16 extending generally vertically. Shaft 16 is connected to a rotor 18 which is disposed within an annular stator 20, said stator including a main body section 21 having a plurality of lands 22, each extending about 15°, spaced around the stator and in an interference fit with shell 10, thus forming a series of passages 24 therebetween. The stator winding end turns 26 project vertically on opposite sides of the stator body 21.

The type of vapor compressing mechanism and the detailed construction thereof, are unimportant to the present invention; but in a preferred embodiment it may take the form of a stator 28 which is sandwiched between a lower bearing plate 30 and an upper bearing plate 32. The lower bearing plate 30 is provided with a thickened central section 34, providing a bearing surface 35 for the driven shaft 16, and a downwardly extending annular perimetral section 29 which rests against the upper portion of the stator body 21 to maintain the same in fixed axial alignment with the motor and driven shaft. The stator 28 is provided with a circular bore 36 which receives a rotor 38 of smaller diameter, the axis of which is offset with respect to the central axis of bore 36. Thus, the upper plate 32, the lower plate 30 and the cylindrical wall of bore 36 cooperate with the rotor 38 to provide a crescent shaped gas working space 39. Sliding vanes 40, carried by the rotor in slots 37, function as vapor pumping means.

As shown in FIGS. 1 and 2, the lower bearing plate 30 is provided with a horn-shaped passageway 41 extending from the suction line 12 (near where it passes through the side wall of shell 10) to the suction zone of gas working space 39. On the opposite side of space 39 there is a discharge port 44 which is covered by a reed valve 46, the upward movement of the valve being limited by valve stop 48. To provide uniform distribution of the discharge gas, there is a foraminous baffle member 50 extending over the zone adjacent to discharge port 44 and it, in turn, is provided with a plurality of ports 52.

It will be noted that an annular space 53 is defined between the outer regions of the stator 28 and the shell 10, and between the upper lower end plates. This space, into which the discharge gas flows through ports 52, is partially sealed by an annular sealing ring 54 which rests on top bearing plate 32 and extends around substantially the entire periphery between said plate and the inner surface of shell 10. An opening 55 is provided on the side of the annular sealing ring 54 oppositely disposed from the discharge valve allowing the discharge gas to flow upwardly into the dome-like chamber 56 above the upper end plate enroute to the discharge line 14 after it passes through annular chamber 53.

An important feature of this invention is the arrangement of a primary oil separator means $S_1$ which completely encircles the chamber 53. This separator preferably takes the form of a cylindrically shaped porous element 58 disposed between the sealing ring 54 and the lower portion 29 of the bearing plate 30. Porous element 58, which may be made of a variety of materials, such as expanded metal, knit wire, perforated or lanced sheet metal, or fine mesh screen, has a large effective area for oil to coalescence as the refrigerant vapor, laden with oil, sweeps around the chamber 53 toward opening 55. Since the separator element 58 is in contact with the interior wall 59 of shell 10, the separated oil will tend to adhere to the wall and drain by gravity in a downward direction to a sump 60 formed in the lower section of the hermetic shell 10. By directing the oil in this manner, the oil will release its heat to the shell wall and be conducted through the relatively thin wall to the ambient air which surrounds the outside of the shell. In small capacity compressors the porous ring may be optional. By simply striking the bare inside surface of the shell, oil will separate and flow downwardly in a similar manner.

The refrigerant vapor flowing through passage 55 will have had a large portion of the oil removed; but to remove additional oil, a secondary oil separator $S_2$ is disposed in the domed upper section of the shell. Oil separator $S_2$ formes the entrance end of the discharge gas line 14 and in a preferred embodiment comprises a tubular body 62 filled with a mesh-like filter medium 64. Oil will tend to coalesce on the filter pads and will drain down toward the sump.

The sump 60 is adapted to collect and hold a body of lubricating oil which is indicated at 65. It should be understood that depending on a number of factors, such as condensing temperature and overall system load, this oil level will fluctuate up and down. The lower end 66 of the shaft 16 is designed so that it always extends below the lowest level of oil expected under such varying operating conditions. While several means for pumping the oil up through the drive shaft are known, the present invention simply utilizes a helical strip 69 received within a bore 67 extending through the shaft. As the drive shaft rotates, oil is scooped up and induced to flow through the riser to areas requiring lubrication.

Figure 4:
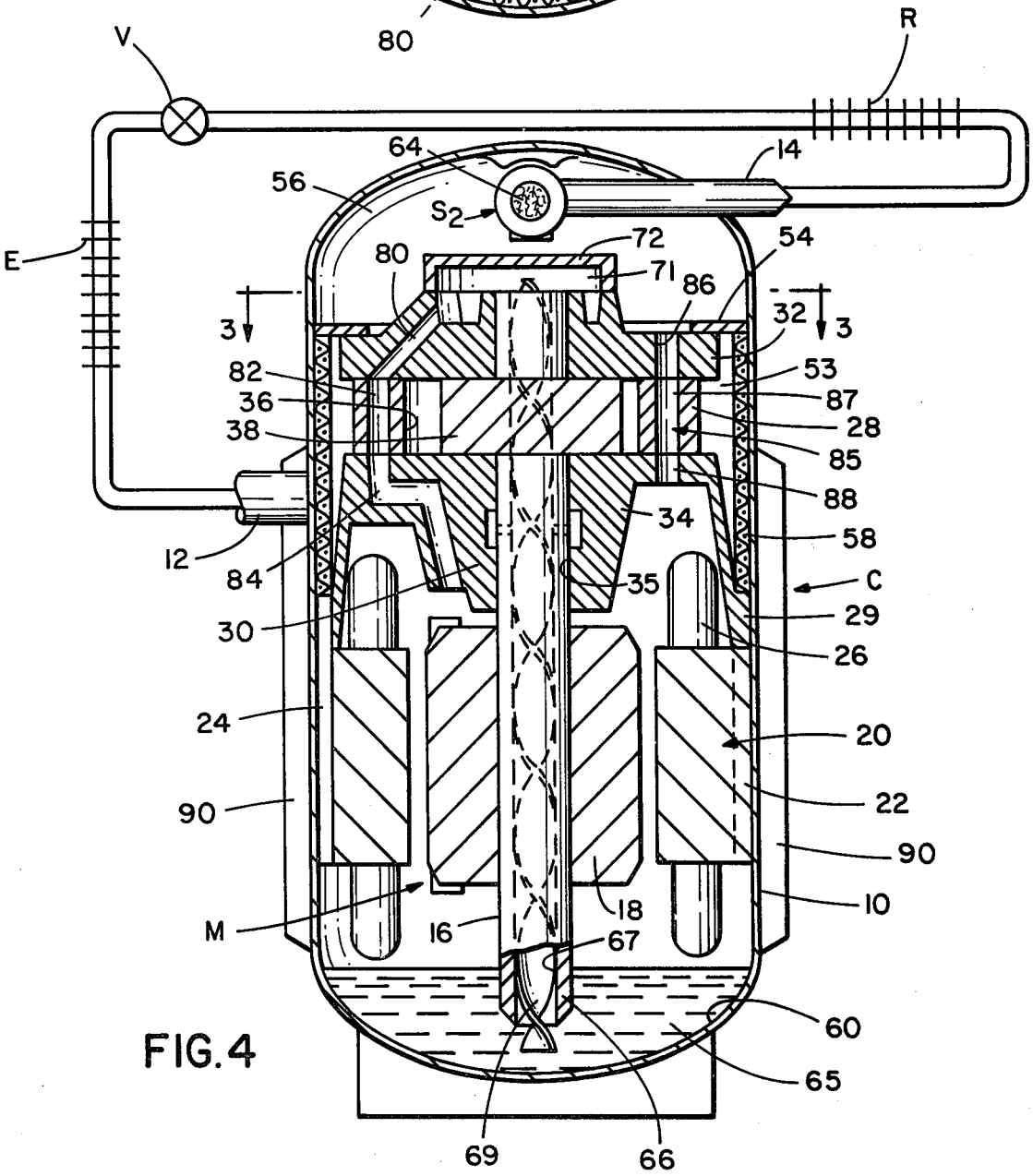
FIG. 4 is a cross section view taken along the plane of line 4—4 of FIG. 3.

In the centrally thickened section of the lower bearing plate 30 there is provided a recessed portion 70 which connects with the oil lift device 69, by way of radial holes 75, in order to lubricate the bearing area 35 in the lower end plate. The oil which is carried past radial holes 75 flows into a chamber 71 extending above the drive shaft and sealed off by a cap member 72 at the upper portion of plate 32. Oil can return directly from chamber 71 through passage 80 in top bearing plate 32 (FIG. 4), passage 82 in stator 28 and passage 84 in the lower bearing plate 30 to cool the motor. The oil which collects above the upper bearing plate returns through a passage 85 formed by aligned holes 86, 87 and 88 in the upper plate 32, the stator 28 and the lower plate 30, respectively. This oil is also directed over the motor for cooling.

Figure 3:
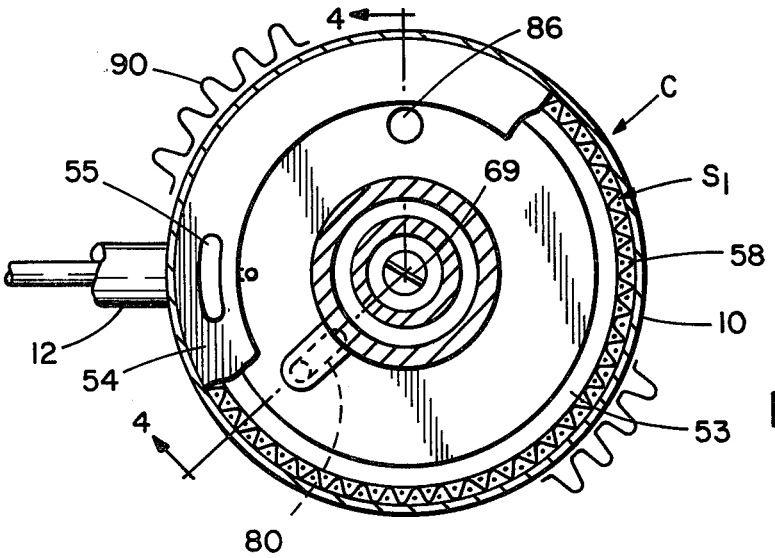
FIG. 3 is a view similar to FIG. 1 taken along the plane of line 3—3 of FIG. 4.

Although significant quantities of heat can be transferred through the shell 10 without heat transfer augmentation, it is desirable to provide means, such as fins 90 (shown fragmentarily in FIGS. 1, 3 and 5), to promote additional cooling of the oil.

OPERATION

Figure 5:
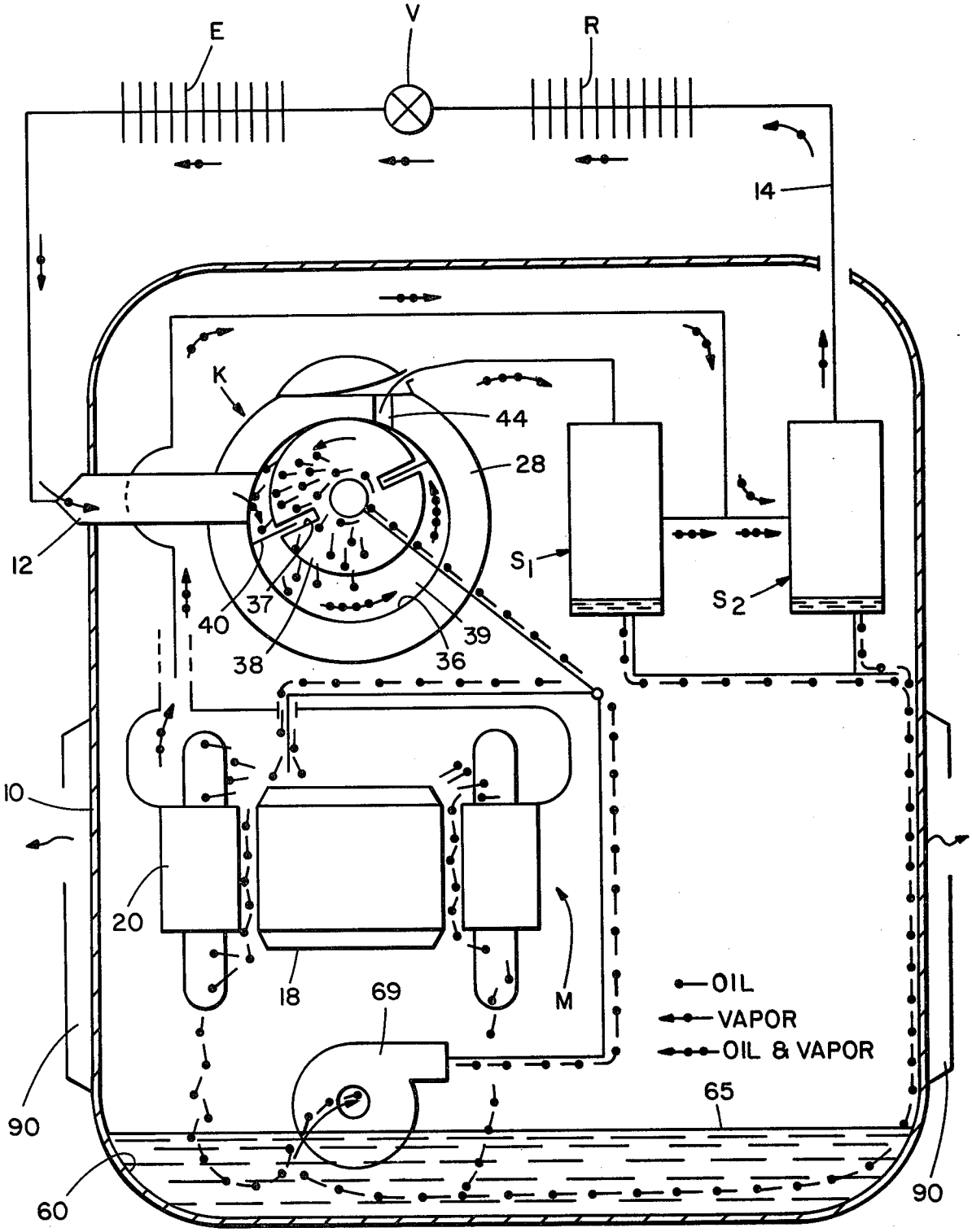
FIG. 5 is a schematic diagram illustrating several functional aspects of the invention.

FIG. 5 shows, in schematic fashion, the typical flow paths of refrigerant vapor, oil, and the mixture of vapor and oil as the system operates in its normal mode. The legend shown on FIG. 5 indicates the respective paths of refrigerant vapor (substantially oil free), oil (substantially vapor free), and a mixture of vapor and oil.

With the compressor operating, suction gas passes from the evaporator E to the suction line 12 and enters the shell through the connecting passage 41 in lower end plate 34. The vapor returning from the evaporator is primarily refrigerant vapor, but does contain some oil. Vapor enters the suction side of the compression cavity and is discharged through ports 44, and valve 46 into the discharge cavity provided by the distributor or baffle member 50.

The vapor, which entrains considerable oil by passing through the compressor, is then directed to the primary oil separator $S_1$, which functionally comprises the annular porous element 58. The oil drains along the wall of the shell 10 and collects in the sump 60.

The vapor, now stripped of the majority of oil, flows through secondary separator $S_2$ and then through discharge line 14 of the condenser. The oil is pumped from sump 60 by the helical oil lift device 69 to the various bearing surfaces, to lubricate and cool the same. Oil is directed over the motor by way of interconnecting passage system 80, 82 and 84, and also through passage 85 from above the top plate 32. After contacting the motor, the oil drains to the sump.

While this invention has been described in connection with a certain specific embodiment thereof, it is to be understood that this is by way of illustration and not by way of limitation; and the scope of the appended claims should be construed as broadly as the prior art will permit.

What is claimed is:

1. A rotary hermetic refrigerant compressor comprising: a rotary, sliding vane refrigerant compressing unit having an inlet and an outlet; a motor operatively connected to drive said compressing unit; a hermetic shell enclosing said compressing unit and said motor; means defining a lubricant sump in the lower portion of said shell; means defining an annular lubricant-refrigerant separator chamber adjacent the outlet of said refrigerant compressing unit, the outer boundary of said chamber being defined by a portion of the inside wall of said shell such that separated lubricant is directed into contact with said inside wall and flows downwardly thereover to said lubricant sump, so that heat is abstracted from said lubricant through said shell wall and rejected to the outside of said shell; and means for directing lubricant from said sump to said motor and compressing unit for lubricating and cooling purposes.

2. Apparatus as defined in claim 1 including a porous separator element in said inlet lubricant refrigerant separator chamber, said separator element having a surface in contact with the inside wall of said shell.

3. Apparatus as defined in claim 2 including a secondary separator positioned in the upper portion of said shell and providing a passage between said compressing unit outlet and the exterior of said hermetic shell.

4. Apparatus as defined in claim 1 wherein said compressing unit is provided in the upper portion of said shell and said motor is positioned in the lower portion of said shell between said sump and said compressing unit.

5. A rotary hermetic refrigerant compressor comprising: a rotary, sliding vane refrigerant compressing unit having an inlet and an outlet; a motor operatively connected to drive said compressing unit; a hermetic shell enclosing said compressing unit and said motor; means defining a lubricant sump in the lower portion of said shell below said motor, said motor being positioned between said compressing unit and said sump; means defining an annular lubricant-refrigerant separator chamber adjacent the outlet of said refrigerant compressing unit, the outer boundary of said chamber being defined by a portion of the inside wall of said shell such that separated lubricant is directed into contact with said inside wall and flows downwardly thereover to said lubricant sump, so that heat is abstracted from said lubricant through said shell wall and rejected to the outside of said shell; means for directing lubricant from said sump to said motor and compressing unit for lubricating and cooling purposes; a separator element in said annular lubricant-refrigerant separator chamber, said separator element having a surface in contact with the inside wall of said shell; a secondary separator positioned in the upper portion of said shell providing a passage between said compressing unit outlet and the exterior of said hermetic shell; and a rotary helical lift pump extending into said sump and adapted to carry lubricant for distribution through lubricating and cooling passages in said motor and said compressing unit.

* * * * *